US009638197B2

(12) United States Patent
Minegishi et al.

(10) Patent No.: US 9,638,197 B2
(45) Date of Patent: May 2, 2017

(54) TURBO COMPRESSOR

(75) Inventors: Atsushi Minegishi, Tokyo (JP); Daisuke Takenaka, Tokyo (JP)

(73) Assignee: IHI CORPORATION (JP)

( * ) Notice: Subject to any disclaimer, the term of this patent is extended or adjusted under 35 U.S.C. 154(b) by 689 days.

(21) Appl. No.: 13/819,388

(22) PCT Filed: Aug. 22, 2011

(86) PCT No.: PCT/JP2011/068882

§ 371 (c)(1),
(2), (4) Date: Apr. 2, 2013

(87) PCT Pub. No.: WO2012/029580

PCT Pub. Date: Mar. 8, 2012

(65) Prior Publication Data

US 2013/0183146 A1 Jul. 18, 2013

(30) Foreign Application Priority Data

Aug. 31, 2010 (JP) ..... 2010-193209

(51) Int. Cl.
*F01D 15/12* (2006.01)
*F04D 19/00* (2006.01)
(Continued)

(52) U.S. Cl.
CPC ..... *F04D 19/007* (2013.01); *F04D 17/12* (2013.01); *F04D 25/163* (2013.01);
(Continued)

(58) Field of Classification Search
CPC .... F04D 29/063; F04D 29/06; F04D 29/4206; F04D 29/58; F04D 29/5826; F04D 17/12; F05B 2260/211; F05B 2260/99
See application file for complete search history.

(56) References Cited

U.S. PATENT DOCUMENTS 3,001,692 A 9/1961 Schierl ..... 230/130
3,802,795 A * 4/1974 Nyeste et al. ..... 415/122.1
(Continued)

FOREIGN PATENT DOCUMENTS

CN 101504004 A 8/2009
JP 49-020704 2/1974
(Continued)

OTHER PUBLICATIONS

International Search Report and Written Opinion mailed Nov. 8 2011 in corresponding PCT International Application No. PCT/JP2011/068882.

(Continued)

*Primary Examiner* — Jason Shanske
*Assistant Examiner* — Matthew T Largi
(74) *Attorney, Agent, or Firm* — Ostrolenk Faber LLP

(57) ABSTRACT

A turbo compressor is provided that has first, second and third stage compressor blades rotated by a large gear shaft via an acceleration device, and includes a cast integral casing (1) which forms an acceleration unit cover housing the acceleration device, compression unit covers housing the compressor blades, and first, second and third stage cooler chambers (11*a*, 12*a*, 13*a*) which are arranged in parallel at a lower portion thereof, which communicate with the compressor unit covers by fluid passages, and into which first, second and third stage coolers are inserted from the side thereof. An oil tank (21) is integrally formed with the cast integral casing (1) so as to run along an insertion-directional innermost side of the coolers of the parallel-arranged first, second and third stage cooler chambers (11*a*, 12*a*, 13*a*).

7 Claims, 5 Drawing Sheets

(51) Int. Cl.

| | |
|---|---|
| ***F04D 17/12*** | (2006.01) |
| ***F04D 25/16*** | (2006.01) |
| ***F04D 29/42*** | (2006.01) |
| ***F04D 29/58*** | (2006.01) |
| ***F04D 29/063*** | (2006.01) |

(52) U.S. Cl.
CPC ..... *F04D 29/063* (2013.01); *F04D 29/4206* (2013.01); *F04D 29/5826* (2013.01)

(56) References Cited

U.S. PATENT DOCUMENTS

| | | | | |
|---|---|---|---|---|
| 6,692,224 | B2 | 2/2004 | Miura | 415/66 |
| 2012/0183391 | A1* | 7/2012 | Czechowski et al. | F01D 25/20 415/175 |

FOREIGN PATENT DOCUMENTS

| | | | | |
|---|---|---|---|---|
| JP | 5-141397 | * | 6/1993 | F04D 29/70 |
| JP | A-05-141397 | | 6/1993 | |
| JP | 7-103162 | * | 4/1995 | F04C 18/02 |
| JP | A-07-103162 | | 4/1995 | |
| JP | 3470410 | | 11/2003 | |
| JP | 2004-308477 | | 11/2004 | |
| JP | 2007-332826 | * | 12/2007 | |
| JP | A-2007-332826 | | 12/2007 | |

OTHER PUBLICATIONS

Chinese Office Action dated Nov. 4, 2014 in corresponding Chinese Patent Application No. 201180041333.3 with English translation of Search Report (10 pages).

* cited by examiner

TURBO COMPRESSOR

CROSS-REFERENCE TO RELATED APPLICATIONS

The present application is a 35 U.S.C. §§371 national phase conversion of PCT/JP2011/068882, filed Aug. 22, 2011, which claims priority of Japanese Patent Application No. 2010-193209, filed Aug. 31, 2010, the contents of which are incorporated herein by reference. The PCT International Application was published in the Japanese language.

TECHNICAL FIELD

The present invention relates to a turbo compressor.

BACKGROUND ART

Recently, as turbo compressors used, for instance, when compressed air is produced and supplied to demanding places such as a plant, two-stage turbo compressors and three-stage turbo compressors have been known in response to required pressure of the compressed air. These types of turbo compressors have a plurality of compressor blades rotated by a pinion shaft connected to a large gear shaft via an acceleration device. In the turbo compressors, operations of causing a fluid compressed by first stage compressor blades to be cooled by a cooler, then guiding the cooled fluid to second stage compressor blades to compress the cooled fluid again, and guiding the compressed fluid to a separate cooler to cool the compressed fluid are sequentially performed. Furthermore, an operation of feeding oil to the large gear shaft, the acceleration device, and the pinion shaft of the turbo compressor to lubricate the large gear shaft, the acceleration device, and the pinion shaft is performed, and the oil after the lubrication is collected and circulated in an oil tank.

As the two-stage turbo compressor, a configuration in which the oil tank is integrally assembled to a side portion of a box body housing the cooler is known (see Patent Document 1). However, it is difficult to manufacture the configuration adapted to integrally assemble the box body and the oil tank like the turbo compressor disclosed in Patent Document 1. Accordingly, the two-stage turbo compressor is unfavorable in terms of the productivity and production costs thereof.

As the three-stage turbo compressor, a configuration in which an acceleration unit cover housing the acceleration device, a plurality of compression unit covers housing the compressor blades, and cooler chambers that individually house elongate multi-stage coolers arranged in parallel at a lower portion thereof and are spatially connected between the compression unit covers by fluid passages are formed by a cast integral casing is known (see Patent Document 2).

PRIOR ART

Patent Document

[Patent Document 1]: Japanese Patent No. 3470410

[Patent Document 2]: Japanese Unexamined Patent Application, First Publication No. 2004-308477

SUMMARY OF THE INVENTION

Problems to be Solved by the Invention

In the three-stage turbo compressor disclosed in Patent Document 2, since the configuration in which the cooler chambers are housed in the cast integral casing is employed, connection piping for installing the cooler chambers can be omitted, and the number of parts of the apparatus can also be reduced, compared to a configuration in which the cooler chambers are separately installed. Accordingly, a compact three-stage turbo compressor can be obtained.

However, in the three-stage turbo compressor disclosed in Patent Document 2, a configuration in which the oil tank is separately installed is employed. Accordingly, long connection piping for collecting the oil after the lubrication into the oil tank is required for the turbo compressor, and the number of parts of the apparatus is also increased. As a result, the configuration of the entire turbo compressor is enlarged.

The present invention has been made keeping in mind the above problems and is intended to provide a turbo compressor that has a simplified configuration and is more compact, compared to a conventional turbo compressor.

Means for Solving the Problems

To accomplish the object, according to a first aspect of the present invention, there is provided a turbo compressor which has first, second, and third stage compressor blades rotated by two pinion shafts connected to a large gear shaft via an acceleration device, and which comprises a cast integral casing which forms an acceleration unit cover housing the acceleration device, compression unit covers housing the compressor blades, and first, second, and third stage cooler chambers which are disposed at a lower portion thereof so as to individually house first, second, and third stage coolers in a state in which the first, second, and third stage coolers are arranged in parallel in an elongated shape and which are spatially connected to the compression unit covers by fluid passages. An oil tank is integrally formed with the cast integral casing so as to run along a longitudinal innermost side of the first, second, and third stage cooler chambers arranged in parallel.

Furthermore, in the turbo compressor, the cast integral casing may have a main oil pump and an oil cooler disposed thereon so as to pump up and cool the oil in the oil tank and then to feed the cooled oil to the large gear shaft, the acceleration device, and the pinion shafts.

In addition, in the turbo compressor, among the first, second, and third stage cooler chambers arranged in parallel, the cooler chamber located at a parallel-arrangement-directional end of the cooler chambers extends to avoid the oil tank, and an extension part thereof may have a fluid outlet and a drain outlet.

Effects of the Invention

According to the turbo compressor of the present invention, the oil tank is integrally formed with the cast integral casing so as to run along a longitudinal innermost side of the first, second, and third stage cooler chambers. Accordingly, it is possible to obtain the turbo compressor having a compact configuration. Further, a volume of the oil tank of the turbo compressor can be sufficiently secured.

Furthermore, since the oil of the oil tank can flow down and be guided after lubricating the large gear shaft, the acceleration device, and the pinion shaft, piping for guiding the oil after the lubrication to the oil tank as in a case in which the oil tank is separately installed can be omitted.

Furthermore, by disposing the main oil pump and the oil cooler on the cast integral casing, the length of the piping can be shortened, and the number of parts of the apparatus can be reduced. Accordingly, it is possible for the turbo compressor to have a more compact configuration.

In addition, by extending a part of the cooler chambers to form a fluid outlet and a drain outlet in an extension part of the cooler chamber, a drain can move along with a flow of fluid to successfully discharge from the drain outlet.

EMBODIMENTS OF THE INVENTION

Hereinafter, an embodiment of the present invention will be described along with shown examples.

Figure 1:
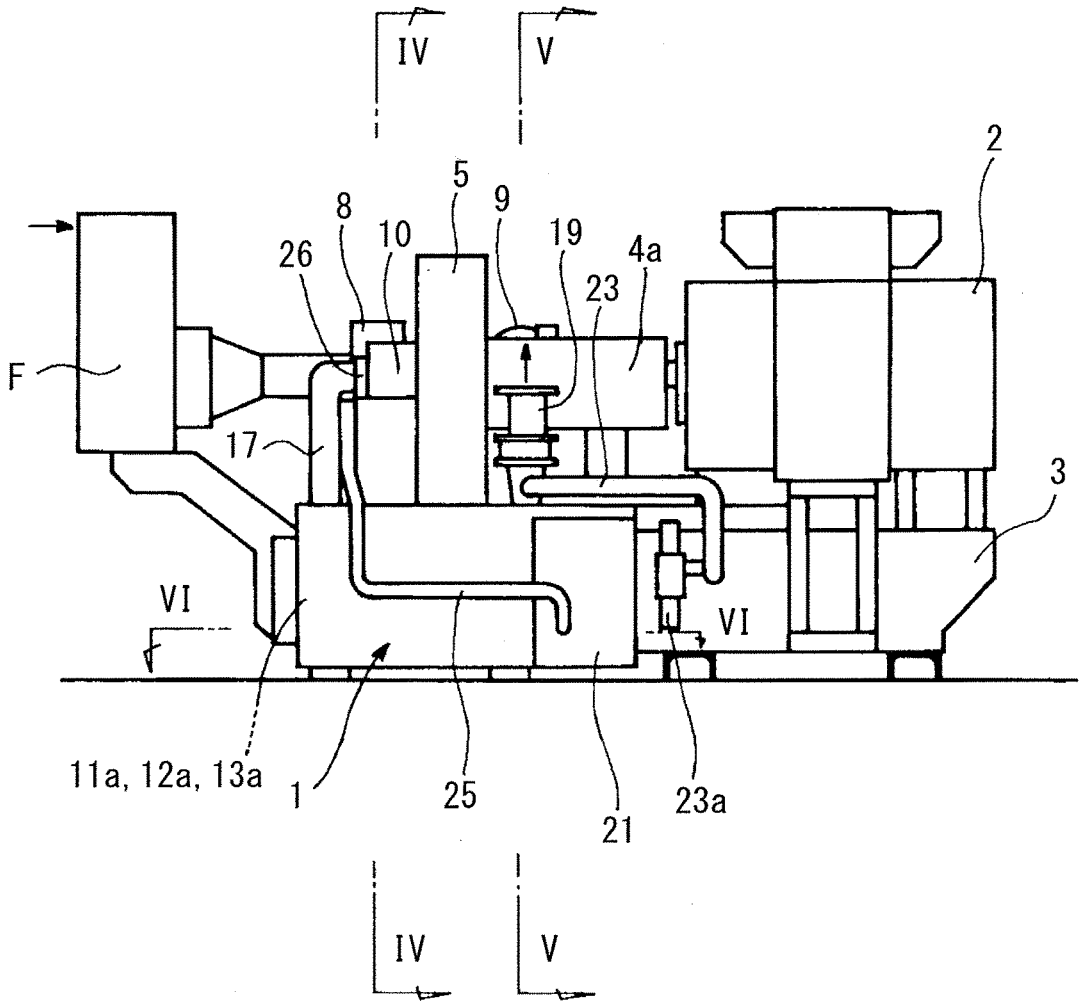
FIG. 1 is a front view showing an example of a turbo compressor according to an embodiment of the present invention.
Figure 2:
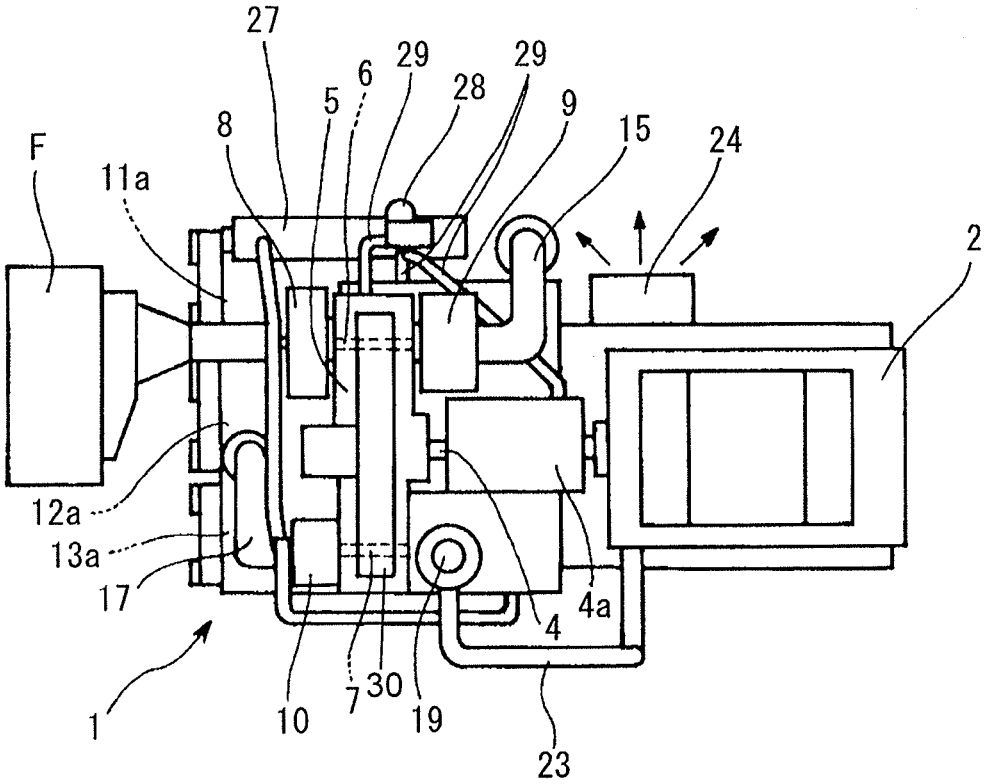
FIG. 2 is a plan view of FIG. 1.
Figure 3:
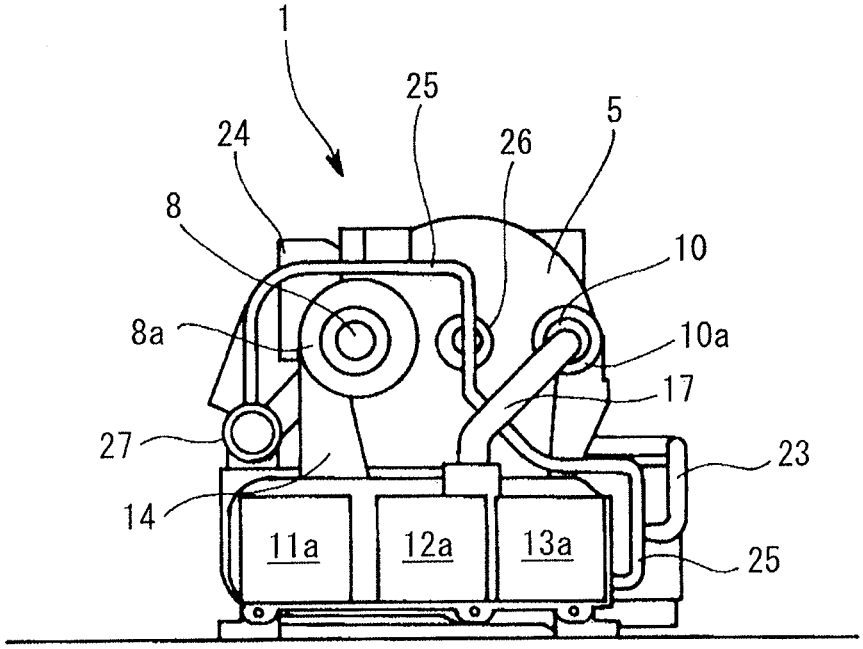
FIG. 3 is a left side view of FIG. 1.
Figure 4:
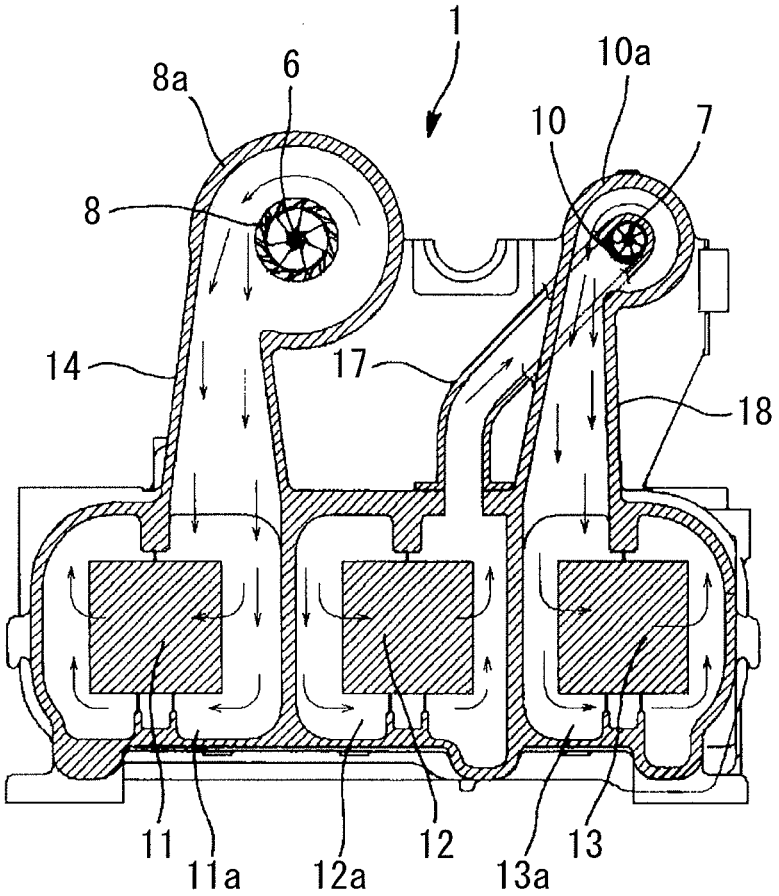
FIG. 4 is a cross-sectional view taken in a direction IV-IV of FIG. 1.
Figure 5:
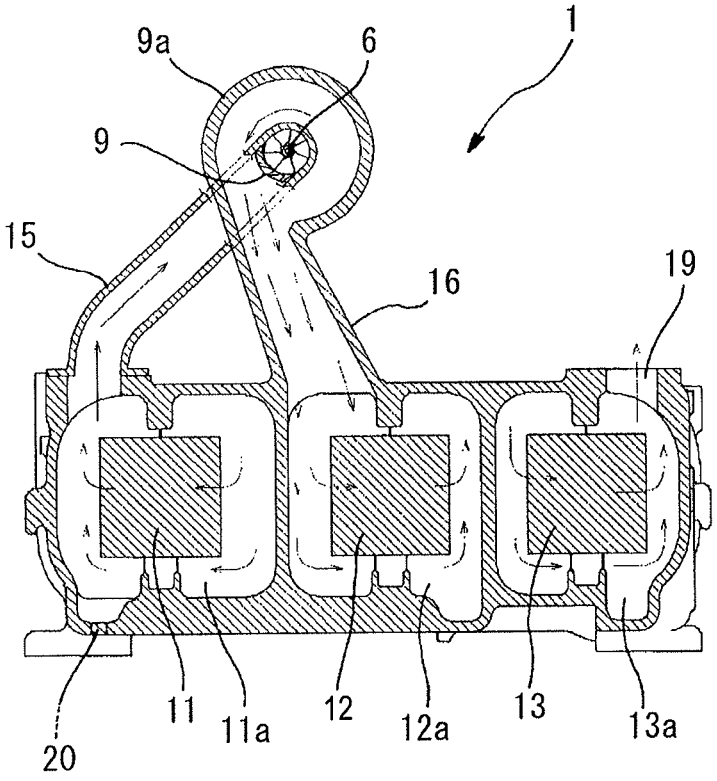
FIG. 5 is a cross-sectional view taken in a direction V-V of FIG.
Figure 6:
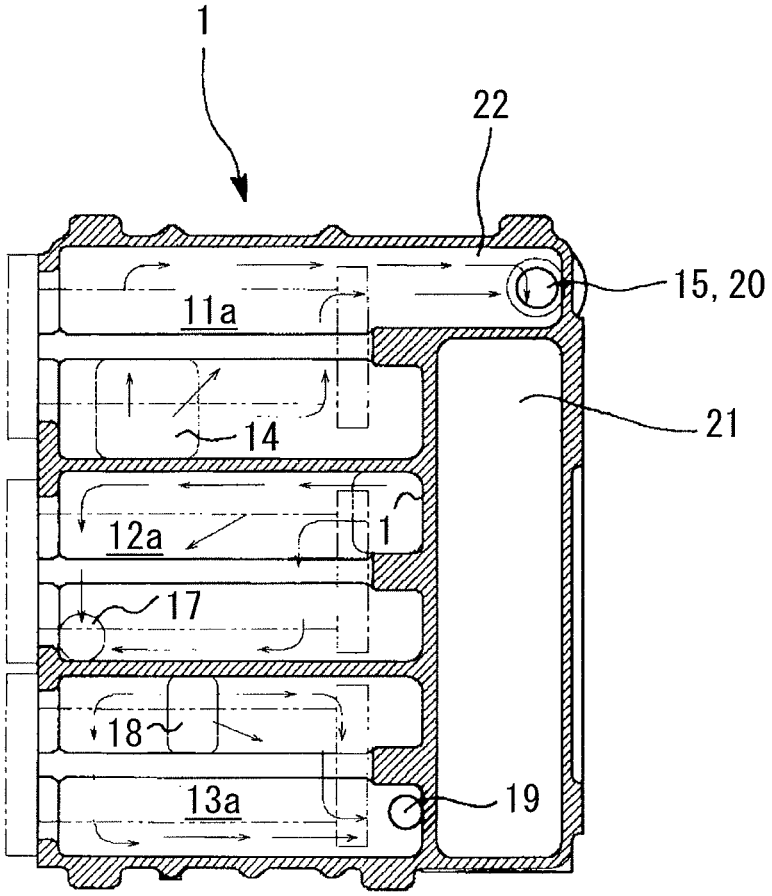
FIG. 6 is a cross-sectional view taken in a direction VI-VI of FIG. 1.

FIGS. 1 to 6 show an example of a turbo compressor according to an embodiment of the present invention. FIG. 1 is a front view of the turbo compressor, and FIG. 2 is a plan view of FIG. 1. FIG. 3 is a left side view of FIG. 1, and FIG. 4 is a cross-sectional view taken in a direction IV-IV of FIG. 1. FIG. 5 is a cross-sectional view taken in a direction V-V of FIG. 1. And FIG. 6 is a cross-sectional view taken in a direction VI-VI of FIG. 1.

In FIGS. 1 to 3, reference numeral 1 indicates a cast integral casing constituting a main body of the turbo compressor, and reference numeral 2 indicates a motor constituting a driving device of the main body of the compressor. The motor 2 is installed on a motor bed 3 assembled to the cast integral casing 1. The motor 2 is connected to a large gear 30 of an acceleration device 5 the cast integral casing 1 via a coupling 4*a* and a large gear shaft 4. Two pinion shafts 6 and 7 are meshed with and provided on an outer circumference of the large gear 30 of the acceleration device 5. As shown in FIGS. 4 and 5, first stage compressor blades 8 and second stage compressor blades 9 are attached to one pinion shaft 6, and third stage compressor blades 10 are attached to the other pinion shaft 7.

As shown on the left ends of FIGS. 1 and 2, a first stage cooler chamber 11*a*, a second stage cooler chamber 12*a*, and a third stage cooler chamber 13*a*, each of which has an opening, are provided on a lower inner side of the cast integral casing 1. As shown in FIG. 3, the first stage cooler chamber 11*a*, the second stage cooler chamber 12*a*, and the third stage cooler chamber 13*a* are integrally formed in a state in which the first stage cooler chamber 11*a*, the second stage cooler chamber 12*a*, and the third stage cooler chamber 13*a* are arranged in parallel in a front-back direction. As shown in FIGS. 3 to 5, a first stage cooler 11 (inter cooler), a second stage cooler 12 (inter cooler), and a third stage cooler 13 (after cooler) are respectively inserted in the cooler chambers 11*a*, 12*a*, and 13*a*. The first stage cooler 11, the second stage cooler 12, and the third stage cooler 13 are inserted from the left side of FIGS. 1 and 2 to innermost portions of the cooler chambers 11*a*, 12*a*, and 13*a* via the openings. The cooler chambers 11*a*, 12*a*, and 13*a* are connected to compression unit covers 8*a*, 9*a*, and 10*a* formed so as to cover the compressor blades 8, 9, and 10 via fluid passages, respectively.

As shown in FIGS. 3 to 6, the fluid, which is introduced from a filter F and is compressed by the first stage compressor blades 8, is guided to the vicinity of an insertion side of the first stage cooler chamber 11*a* by the fluid passage 14, and is cooled by the first stage cooler 11. Then, the cooled fluid is guided to the second stage compressor blades 9 having the same axis as the first stage compressor blades 8 by a fluid passage 15 provided at an innermost portion end and is compressed by the second stage compressor blades 9. The fluid compressed here is guided to an innermost end of the second stage cooler chamber 12*a* by a fluid passage 16 and is cooled by the second stage cooler 12. Then, the cooled fluid is guided to the third stage compressor blades by a fluid passage 17 provided nearby and is compressed by the third stage compressor blades 10. The fluid compressed here is guided to the vicinity of the third stage cooler chamber 13*a* by a fluid passage 18, is cooled by the third stage cooler 13, and then is extracted upwards from a fluid outlet 19 installed on an innermost end of the third stage cooler chamber 13*a*. Further, in the first stage cooler chamber 11*a*, a drain outlet 20 is installed below an opening of the fluid passage 15. A blowoff pipe 23 is connected to the fluid outlet 19. An amount of blowoff is regulated by a flow control valve 23*a* installed on the blowoff pipe 23, and the blowoff is performed from a silencer 24.

In the aforementioned cast integral casing 1, as shown in FIGS. 1 and 6, an oil tank 21 is integrally formed at an insertion-directional innermost side of the cooler chambers 11*a*, 12*a*, and 13*a* arranged in parallel in a horizontal direction so as to run in a direction in which the cooler chambers 11*a*, 12*a*, and 13*a* are arranged in parallel.

In the cooler chamber 11*a* located at a parallel-arrangement-directional end of the chambers 11*a*, 12*a*, and 13*a* and at an uppermost portion of the cooler chambers 11*a*, 12*a*, and 13*a* arranged in parallel in the up-and-down direction of the space of FIG. 6, an extension part 22 is formed at an insertion-directional innermost side of the coolers. The drain outlet 20 is formed below a fluid outlet of the fluid passage 15 that is open to an upper side of the extension part 22. Accordingly, since the oil tank 21 is installed alongside the innermost side of the cooler chambers 11*a*, 12*a*, and 13*a* arranged in parallel, despite being formed away from the extension part 22, the oil tank can have a sufficient volume.

An upper portion of the cast integral casing 1 shown in FIGS. 1 and 3 is provided with a main oil pump 26 pumping up the oil of the oil tank 21 via a suction pipe 25, and an oil cooler 27 introducing and cooling the oil of an outlet of the main oil pump 26 from one end thereof. A lubricating system is configured to force the oil, which is cooled by the oil cooler 27 and is guided out of the other end, to pass through an oil filter 28, and then to be fed to and lubricate lubrication parts such as the large gear shaft 4, the acceleration device 5, and the pinion shafts 6 and 7 by a feed pipe 29. The oil used for the lubrication flows down to return to the oil tank 21.

Next, an operation of the embodiment will be described.

In the turbo compressor of the present invention, since the oil tank 21 is integrally formed with the cast integral casing 1 so as to run along a longitudinal innermost side of the first, second, and third stage cooler chambers 11*a*, 12*a*, and 13*a*, the oil tank 21 can secure a sufficient volume.

When the main oil pump 26 installed at the upper portion of the cast integral casing 1 is driven, the oil of the oil tank 21 is suctioned by the suction pipe 25, and is fed to and cooled by the oil cooler 27. The oil cooled by the oil cooler 27 passes through the oil filter 28, and then is fed to and lubricates the lubrication parts such as the large gear shaft 4, the acceleration device 5, and the pinion shafts 6 and 7 via the feed pipe 29. Thus, the oil used for the lubrication flows down to return to the oil tank 21.

As described above, since the oil tank 21 is integrally formed with the cast integral casing 1, the oil lubricating the large gear shaft 4, the acceleration device 5, and the pinion shafts 6 and 7 can flow down to return to the oil tank 21. Accordingly, the piping for guiding the oil after the lubrication to the oil tank as in the case in which the oil tank is separately installed can be omitted.

Furthermore, by disposing the main oil pump 26 and the oil cooler 27 on the cast integral casing 1, the length of the piping for circulating the oil can be shortened, and the number of parts of the apparatus can be reduced. Accordingly, a compact turbo compressor can be obtained.

In addition, by extending the first stage cooler chamber 11*a* to form the drain outlet 20 below the fluid outlet of the fluid passage 15 installed at an upper side of the extension part 22 of the cooler chamber 11*a*, a drain moves in the same direction as a flow of the fluid in the first stage cooler chamber 11*a*. Accordingly, the drain can successfully discharge from the drain outlet 20.

The turbo compressor of the present invention is not limited only to the aforementioned embodiment, but it can be naturally modified in various ways without departing from the spirit of the present invention.

INDUSTRIAL APPLICABILITY

According to the present invention, it is possible to obtain a turbo compressor that has a compact configuration and is equipped with an oil tank having a sufficient volume.

DESCRIPTION OF REFERENCE NUMERALS

1: cast integral casing, 2: motor, 3: motor bed, 4: large gear shaft, 5: acceleration device, 6, 7: pinion shaft, 8: first stage compressor blade, 8*a*: compression unit cover, 9: second stage compressor blade, 9*a*: compression unit cover, 10: third stage compressor blade, 10*a*: compression unit cover, 11: first stage cooler, 11*a*: first stage cooler chamber, 12: second stage cooler, 12*a*: second stage cooler chamber, 13: third stage cooler, 13*a*: third stage cooler chamber, 14: fluid passage, 15: fluid passage, 16: fluid passage, 17: fluid passage, 18: fluid passage, 19: fluid outlet, 20: drain outlet, 21: oil tank, 22: extension part, 26: main oil pump, 27: oil cooler

The invention claimed is:

1. A turbo compressor having first, second, and third stage compressor blades rotated by a large gear shaft via an acceleration device, the turbo compressor comprising:

a cast integral casing comprising:

an acceleration unit cover housing the acceleration device;

a compression unit cover housing the respective compressor blades; and first, second, and third stage cooler chambers, which are arranged in parallel at a lower portion of the cast integral casing, into which first, second, and third stage coolers are respectively inserted from a side of the cast integral casing, and which are spatially connected to the compression unit cover via fluid passages and each cooler chamber extends at least from said side of said cast integral casing to a location directly under the acceleration device as viewed from directly above the acceleration device, wherein an oil tank is integrally formed with the cast integral casing so as to run along an insertion-directional innermost side of the first, second, and third stage cooler chambers.

2. The turbo compressor according to claim 1, wherein the cast integral casing has a main oil pump and an oil cooler disposed thereon so as to pump up and cool oil of the oil tank and then to feed the cooled oil to the large gear shaft, the acceleration device, and pinion shafts.

3. The turbo compressor according to claim 1, wherein, among the first, second, and third stage cooler chambers arranged in parallel, the first cooler chamber is located at a parallel-arrangement-directional end of the cooler chambers and has a collinear extension part which extends beyond said innermost side of the first, second and third cooler chambers and alongside the oil tank, and said extension part has a fluid outlet and a drain outlet.

4. The turbo compressor according to claim 2, wherein, among the first, second, and third stage cooler chambers arranged in parallel, the first cooler chamber is located at a parallel-arrangement-directional end of the cooler chambers and has a collinear extension part which extends beyond said innermost side of the first, second and third cooler chambers and alongside the oil tank, and said extension part has a fluid outlet and a drain outlet.

5. The turbo compressor according to claim 4, wherein said first, second and third stage cooler chambers extend beyond said location directly under the acceleration device.

6. The turbo compressor according to claim 3, wherein said first, second and third stage cooler chambers extend beyond said location directly under the acceleration device.

7. The turbo compressor according to claim 1, wherein said first, second and third stage coolers extend beyond said location directly under the acceleration device.

* * * * *